US005936332A

United States Patent [19]

Krupa et al.

[11] Patent Number: 5,936,332

[45] Date of Patent: Aug. 10, 1999

[54] SPARK PLUG

[75] Inventors: Robert Krupa, Sterling Heights; Chester C. Lulavage, Warren, both of Mich.

[73] Assignee: Century Development International Ltd., Farmington Hills, Mich.

[21] Appl. No.: 08/897,349

[22] Filed: Jul. 21, 1997

[51] Int. Cl.[6] ..... H01T 13/20

[52] U.S. Cl. ..... 313/141; 313/138; 313/140

[58] Field of Search ..... 313/141, 123, 313/138, 140; 123/169 EL

[56] References Cited

U.S. PATENT DOCUMENTS

| | | | |
|---|---|---|---|
| 4,416,228 | 11/1983 | Benedikt et al. | 313/141 |
| 4,914,343 | 4/1990 | Kagawa et al. | 313/141 X |
| 5,280,214 | 1/1994 | Johnson | 313/139 |
| 5,369,328 | 11/1994 | Gruber et al. | 313/141 |
| 5,408,961 | 4/1995 | Smith | 123/169 R |
| 5,420,473 | 5/1995 | Thomas | 313/141 |
| 5,510,668 | 4/1996 | Rohwein et al. | 313/141 |
| 5,527,198 | 6/1996 | Chiu et al. | 445/7 |

*Primary Examiner*—Ashok Patel

*Attorney, Agent, or Firm*—Gifford, Krass, Groh, Sprinkle, Anderson & Citkowski, P.C.

[57] ABSTRACT

A very unique universal bi-directional firing spark plug for any spark-ignited internal combustion engine is described. This spark plug eliminates misfire and improves gas mileage, peaks engine performance, horsepower, and increases the RPM range. This unique spark plug is made of an elongated or non-elongated body with an electrical connector at one end. An absolute aerodynamic semispherical dome or sphere electrode is secured to the other end of the body. At least one absolute aerodynamic semicircular electrode is also secured to the body adjacent to the dome or sphere electrode such that the semicircular electrode has its inner surface equidistantly spaced from the dome or sphere electrode's surface. The electrodes can be fabricated from various metals, alloys, and/or precious metals and can also be coated with various metals, alloys, and/or precious metals. Alternate embodiments of the invention include two, three or four or more semicircular electrodes, all of which have a surface equidistantly spaced from the aerodynamic semispherical dome or sphere electrode along its complete arc length.

10 Claims, 8 Drawing Sheets

SPARK PLUG

BACKGROUND OF THE INVENTION

I. Field of the Invention

The present invention relates generally to bi-directional firing spark plugs for all internal combustion engines.

II. Description of the Prior Art

There are many previously known spark plugs of the type used in internal combustion engines. These spark plugs typically comprise an elongated body having an electrical connector at one end. A pair of variable-spaced electrodes are provided at the other end and one of those electrodes is electrically connected to the electrical connector.

In many of these previously known spark plugs, one of the electrodes consists of a cylindrical post while the second electrode is generally L-shaped and has a portion which overlies one end of the cylindrical post. Consequently, upon the application of voltage to the cylindrical post, a spark is formed between the end of the cylindrical post and the overlying portion of the other L-shaped electrode. The spark, of course, tries to ignite the fuel in the combustion chamber of the internal combustion engine.

As is well known, an electrical spark between the post and the other electrode will occur at the position of the shortest distance between the two electrodes. Consequently, with these previously known spark plugs, the spark repeatedly strikes or extends between the same two surfaces on the two electrodes during the operation of the spark plug. This has many disadvantages.

One disadvantage is that, since the spark repeatedly strikes the same area on both electrodes, a portion of the electrodes is repeatedly ablated by the spark, which can result in premature failure of the spark plug.

Another disadvantage is the smolder caused by conventional L-shaped wire that obstructs and diverts the incoming air fuel charge, causing a lighting and quenching and relighting of the flame front.

A more serious disadvantage of these previously known spark plugs, however, is that, due to ionization caused by the spark during operation of the spark plug, the spark plug repeatedly misfires during operation of the internal combustion engine due to the small surface firing area. For each misfire of the spark plug, the fuel within the combustion chamber is not ignited but, instead, exhausted to the atmosphere. This adversely affects not only the efficiency of the engine, it causes fouling of the plugs and increases the exhaust of noxious fumes and pollutants to the atmosphere causing SMOG. This is particularly critical, moreover, due to ever increasing governmental regulations and environmental concerns regarding the permissible level of emissions from spark-ignited internal combustion engines.

SUMMARY OF THE PRESENT INVENTION

The present invention provides a unique universal bidirectional-firing low emission spark plug for all spark-ignited internal combustion engines which overcomes the above-mentioned disadvantages of the previously known spark plugs.

In brief, the spark plug of the present invention comprises an elongated or non-elongated body having an electrical connector at one end. An aerodynamic semispherical dome electrode is secured to the other end of the body and the connector and aerodynamic semispherical dome electrode are electrically connected together.

At least one spherical or semicircular electrode is also secured to the body such that the semicircular electrode has its inner surface equidistantly spaced from the outer surface of an aerodynamic semispherical dome electrode. The shape of the cross-section of the semicircular electrode can be circular, elliptical, rectangular, rectangular with rounded edges, square, square with rounded edges, trapezoidal, trapezoidal with rounded edges, and/or arced such that the semicircular electrode's inner surface is equidistantly spaced from the dome electrode's surface. Consequently, during the operation of the spark plug, the spark between the semispherical and semicircular electrodes continuously travels back and forth along the length of the semicircular electrode. In doing so, misfiring is completely eliminated by the spark constantly moving away from the previously generated ionization zone. The electrodes can be fabricated from various metals, alloys, and/or precious metals and can also be coated with various metals, alloys, and/or precious metals.

In alternative embodiments of the invention, two, three or four or more semicircular electrodes are secured to the spark plug body. These multiple semicircular electrodes each have its inner surface equidistantly spaced from the aerodynamic semispherical dome electrode, so that the spark between the semispherical dome electrode and the semicircular electrode travels along multiple semicircular electrodes.

Preferably, the semispherical electrode forms the anode while the semicircular electrode(s) form the cathode. Depending on what ignition system the spark plug is installed in, the semispherical dome electrode could be the cathode, while the semicircular electrode forms the anode.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
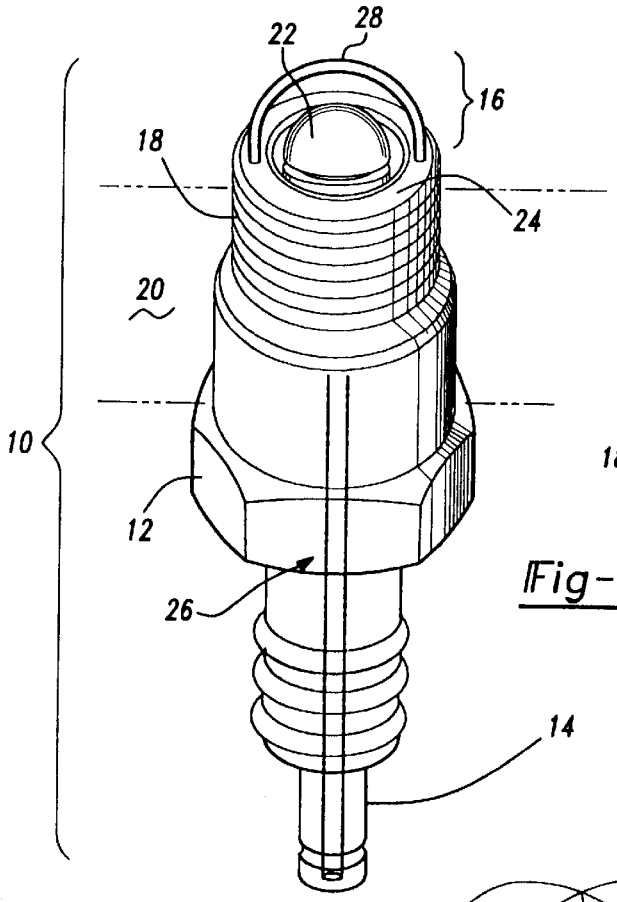
FIG. 1 is an elevational view illustrating a preferred embodiment of the present invention.

With reference first to FIG. 1, a first preferred embodiment of the spark plug 10 of the present invention is there shown and comprises an elongated body 12 that can have many different shapes, typically constructed of a metallic/alloy or other electrical conducting material, as well as an electrical insulator of varying chemical composition. An electrical connector 14 is attached to one end of the body while an electrode assembly 16 is provided at the opposite end of the body 12. An externally threaded metal boss 18 of various sizes is also secured to the body 12 adjacent the electrode assembly 16 for attaching the spark plug 10 to an internal combustion engine 20 (illustrated only diagrammatically).

Figure 2:
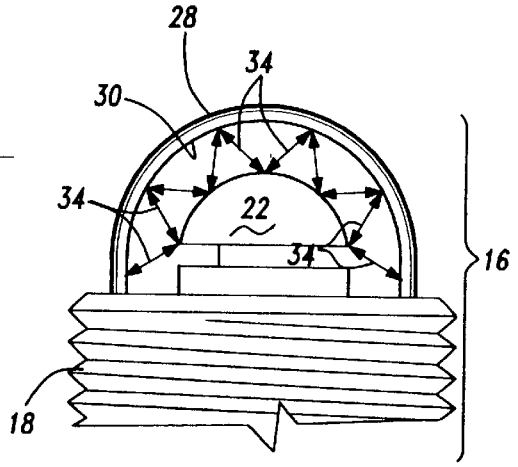
FIG. 2 is a diagrammatic view illustrating the operation of the preferred embodiment of the present invention.

With reference now particularly to FIGS. 1 and 2, the electrode assembly 16 is there shown in greater detail and comprises an aerodynamic semispherical dome electrode 22 and a semicircular electrode 28. The aerodynamic semispherical dome electrode 22 is coaxial with the spark plug body 12 and protrudes outwardly from one end 24 of the spark plug body 12. Any conventional means 26 (FIG. 1) is used to electrically connect the electrical connector 14 to the semispherical electrode 22.

The electrode assembly 16 further includes a semicircular electrode 28 having its inner surface 30 facing the aerodynamic semispherical dome electrode 22. The semicircular electrode 28, furthermore, is secured to the spark plug body 12 such that its inner surface 30 is equidistantly spaced along its length from the outer surface of the semispherical electrode 22. Furthermore, the semicircular electrode 28 is electrically connected to the metal boss 18 and thus to the internal combustion engine 20.

With reference now to FIG. 2, the operation of the first preferred embodiment of the spark plug 10 of the present invention is there shown. In operation, electrical voltage applied to spark ignition wire (not shown) to the electrical connector 14 (FIG. 1) is conducted to the semispherical electrode 22. The voltage potential between the semispherical electrode 22 and semicircular electrode 28 thus causes a spark 34 to extend between the electrode 22 and electrode 28. In the conventional fashion, the spark 34 ignites the fuel within the engine combustion chamber.

Still referring to FIG. 2, unlike the previously known spark plugs, because the outer surface of the aerodynamic semispherical dome electrode 22 is equidistantly spaced from the inner surface 30 of the semicircular electrode 28, repeated sparking of the spark plug 10 causes the spark 34 to "walk along" the adjacent surfaces of these two electrodes so that the spark 34 does not always extend between the same spots on the electrodes 22 and 28 as in the previously known spark plugs. In doing so, the spark plug 10 of the present invention not only exhibits a longer life, but also eliminates misfirings of the spark plug and greatly reduces emissions from the engine.

Typically, a positive voltage is applied to the electrical connector 14 (FIG. 1) and thus to the aerodynamic semispherical dome electrode 22 while the semicircular electrode 28 is maintained at the electrical ground of the internal combustion engine 20. As such, the aerodynamic semispherical dome electrode forms an anode while the semicircular electrode 28 forms a cathode. However, the electrical polarities of the electrodes 22 and 28 may be reversed while still remaining within the scope of the present invention.

Figure 3:
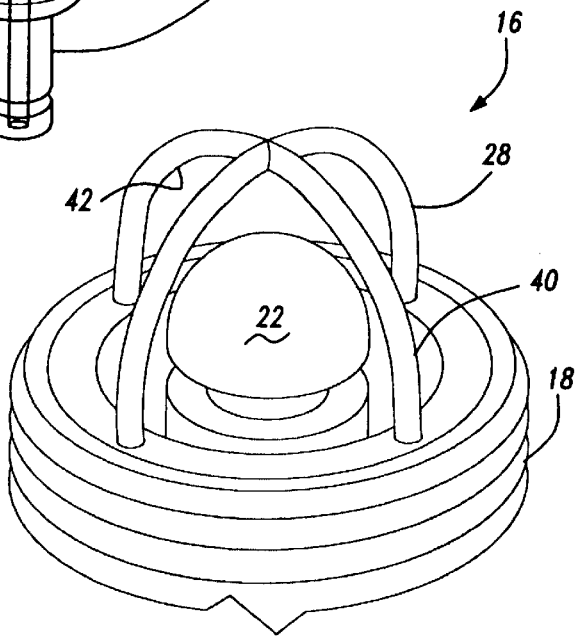
FIG. 3 is an elevational view illustrating a portion of a second preferred embodiment of the present invention.

With reference now to FIG. 3, the second preferred embodiment of the present invention is there shown in which the electrode assembly 16, as before, includes an aerodynamic semispherical dome electrode 22 as well as the semicircular electrode 28. Additionally, however, the electrode assembly 16 includes a second semicircular electrode 40 having an inner surface 42 along its length which is equidistantly spaced from the aerodynamic semispherical dome electrode 22. The second semicircular electrode 40, like the electrode 28, is electrically connected to the metal boss 18 as well as to the first semicircular electrode 28.

Still referring to FIG. 3, preferably the second semicircular electrode 40 intersects the first semicircular electrode 28 generally perpendicularly. Additionally, the semicircular electrodes 28 and 40 are also preferably of a one-piece construction. During the operation of the spark plug illustrated in FIG. 3, the spark between the aerodynamic semispherical dome electrode 22 and the semicircular electrodes 28 and 40 continuously "walks along" between the electrodes 22 and both electrodes 28 and 40.

Figure 4:
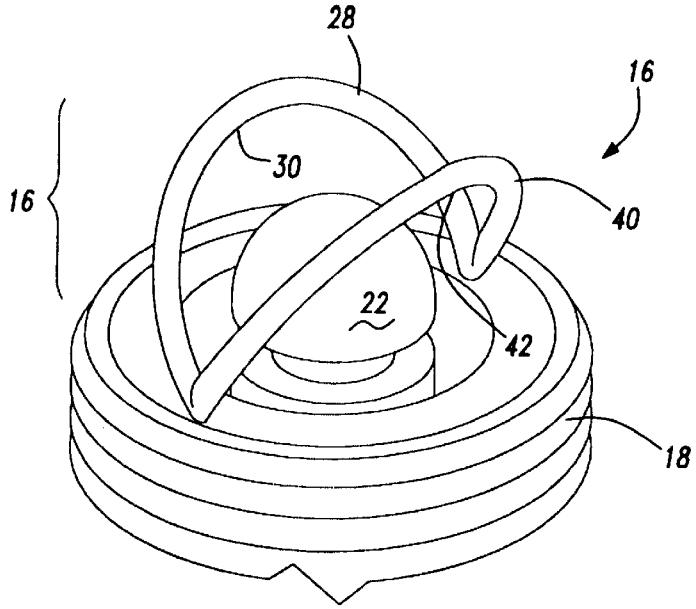
FIG. 4 is an elevational view illustrating a portion of a third preferred embodiment of the present invention.

With reference now to FIG. 4, a still further embodiment of the electrode assembly 16 is there shown and which, like the embodiment illustrated in FIG. 3, includes the aerodynamic semispherical dome electrode 22 as well as two semicircular electrodes 28 and 40. Unlike the embodiment of FIG. 3, however, the semicircular electrodes 28 and 40 intersect each other at their ends at various angles. However, as before, the inner surface 42 of the electrode 40 as well as the inner surface 30 of electrode 28 are equidistantly spaced from the aerodynamic semispherical dome electrode 22.

Figure 5:
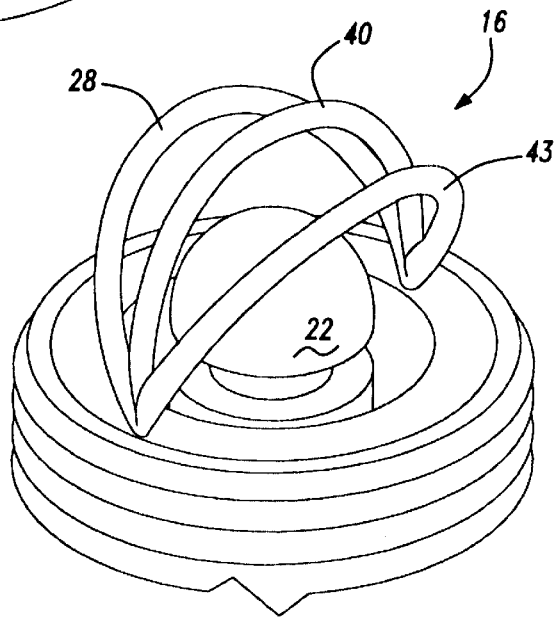
FIG. 5 is an elevational view illustrating a fourth preferred embodiment of the present invention.

With reference now to FIG. 5, a still further embodiment of the electrode assembly 16 is there shown and which, like the embodiment illustrated in FIG. 4, includes the aerodynamic semispherical dome electrode 22 as well as two semicircular electrodes 28 and 40 intersecting each other at their ends at various angles. Unlike the embodiment of FIG. 4, this embodiment contains an additional electrode 43 that intersects electrodes 28 and 40 at their ends. However, as before, the inner surfaces of the three electrodes 28, 40, and 43 are equidistantly spaced from the aerodynamic semispherical dome electrode 22 and, as before, intersect each other at their ends at various angles.

Figure 6:
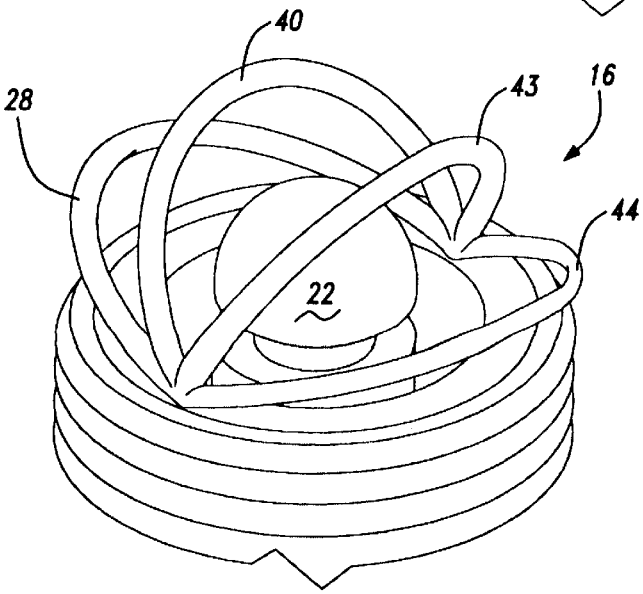
FIG. 6 is an elevational view of a portion of a fifth preferred embodiment of the present invention.

With reference now to FIG. 6, a still further embodiment of the electrode assembly 16 is there shown and which, like the embodiment illustrated in FIG. 5, includes the aerodynamic semispherical dome electrode 22 as well as three semicircular electrodes 28, 40, and 43 intersecting each other at their ends at various angles. Unlike the embodiment of FIG. 5, this embodiment contains an additional electrode 44 that intersects electrodes 28, 40, and 43 at their ends.

However, as before, the inner surfaces of the four electrodes 28, 40, 43, and 44 are equidistantly spaced from the aerodynamic semispherical dome electrode 22, and are at various angles.

Figure 7:
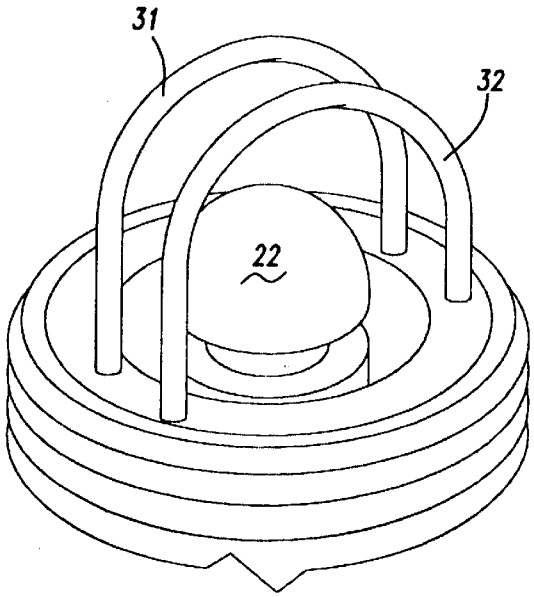
FIG. 7 is an elevational view illustrating a portion of a sixth preferred embodiment of the present invention.

With reference now to FIG. 7, a still further embodiment of the electrode assembly 16 is there shown and which, like the embodiment illustrated in FIG. 4, includes the aerodynamic semispherical dome electrode 22 as well as two semicircular electrodes 31 and 32. Unlike the embodiment of FIG. 4, however, the semicircular electrodes 31 and 32 do not intersect each other at their ends at various angles or at the apex. However, as before, the inner surfaces of electrodes 31 and 32 are equidistantly spaced from the aerodynamic semispherical dome electrode 22.

Figure 8:
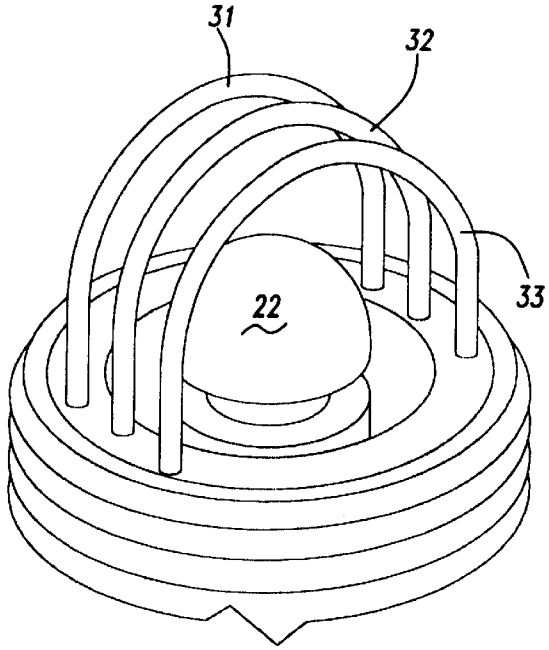
FIG. 8 is an elevational view illustrating a portion of a seventh preferred embodiment of the present invention.

With reference now to FIG. 8, a still further embodiment of the electrode assembly 16 is there shown and which, like the embodiment illustrated in FIG. 7, includes the aerodynamic semispherical dome electrode 22 as well as two semicircular electrodes 31 and 32. Unlike the embodiment of FIG. 7, however, this embodiment contains a third semicircular electrode 33 that does not intersect semicircular electrodes 31 and 32 at their ends at various angles or at the apex. However, as before, the inner surfaces of electrodes 31, 32, and 33 are equidistantly spaced from the aerodynamic semispherical dome electrode 22.

Figure 9:
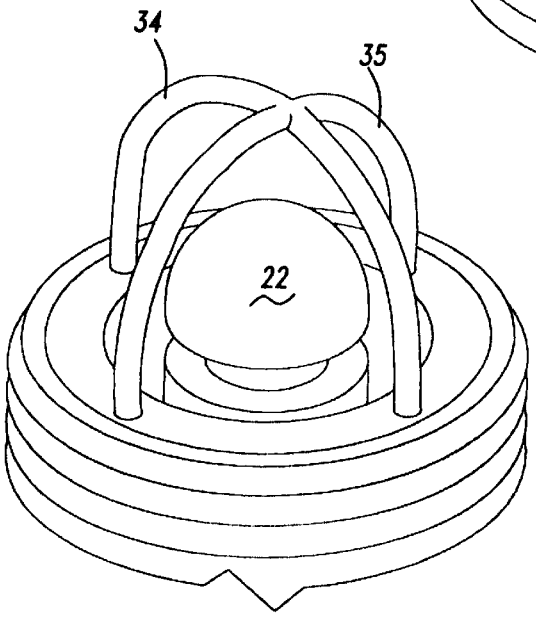
FIG. 9 is an elevational view illustrating an eighth preferred embodiment of the present invention.

With reference now to FIG. 9, a still further embodiment of the electrode assembly is there shown and which, like the embodiment illustrated in FIG. 3, includes an aerodynamic semispherical dome electrode 22 as well as two semicircular electrodes 34 and 35. Unlike the embodiment of FIG. 3, however, electrodes 34 and 35 do not intersect perpendicularly at the apex. However, as before, the inner surfaces of electrodes 34 and 35 are equidistantly spaced from the aerodynamic semispherical dome electrode 22.

Figure 10:
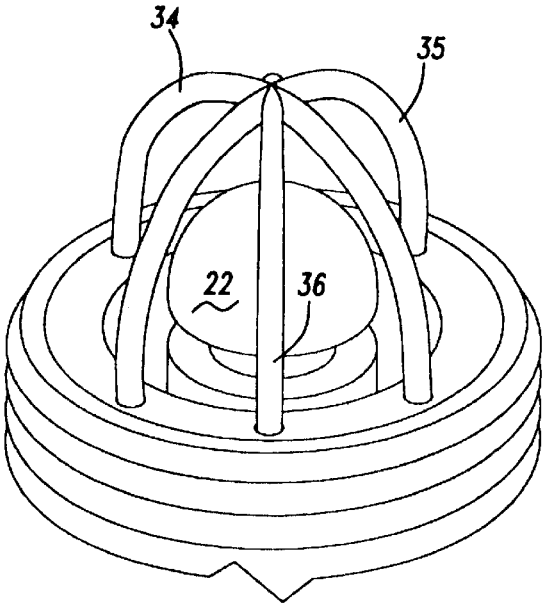
FIG. 10 is an elevational view of a portion of a ninth preferred embodiment of the present invention.

With reference now to FIG. 10, a still further embodiment of the electrode assembly is there shown and which, like the embodiment illustrated in FIG. 9, includes an aerodynamic semispherical dome electrode 22 as well as two semicircular electrodes 34 and 35. Unlike the embodiment of FIG. 9, however, this embodiment contains a third semicircular electrode 36 that intersects electrodes 34 and 35 at the apex. However, as before, the inner surfaces of electrodes 34, 35, and 36 are equidistantly spaced from the aerodynamic semispherical dome electrode 22.

Figure 11:
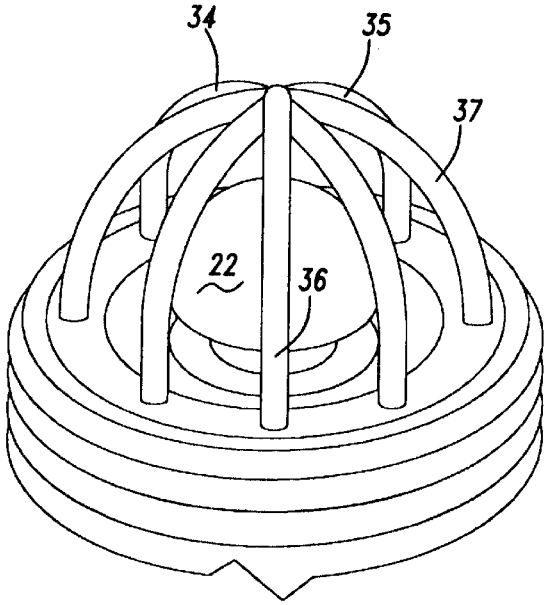
FIG. 11 is an elevational view illustrating a portion of a tenth preferred embodiment of the present invention.

With reference now to FIG. 11, a still further embodiment of the electrode assembly is there shown and which, like the embodiment illustrated in FIG. 10, includes an aerodynamic semispherical dome electrode 22 as well as three semicircular electrodes 34, 35, and 36. Unlike the embodiment of FIG. 10, however, this embodiment contains a fourth semicircular electrode 37 that intersects electrodes 34, 35, and 36 at the apex. However, as before, the inner surfaces of electrodes 34, 35, 36, and 37 are equidistantly spaced from the aerodynamic semispherical dome electrode 22.

Figure 12:
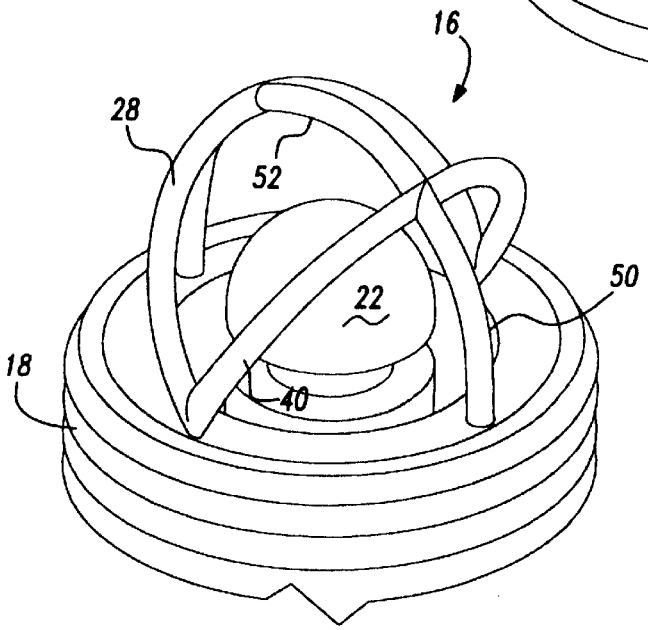
FIG. 12 is an elevational view illustrating a portion of an eleventh preferred embodiment of the present invention.

With reference now to FIG. 12, a still further modification of the electrode assembly 16 is there shown and which, like the embodiment illustrated in FIG. 4, includes a semispherical dome electrode 22 as well as a first and second semicircular electrodes 28 and 40 which are angularly offset from each other and connected at their bases. Unlike the embodiment of FIG. 4, however, in FIG. 12 a third semicircular electrode 50 is also provided which intersects the other two semicircular electrodes 28 and 40 generally perpendicularly. Preferably, all three electrodes 28, 40 and 50 are of a one-piece construction and all three electrodes 28, 40 and 50 are electrically connected not only to each other, but also the metal boss 18. Additionally, as before, the inner surfaces of the semicircular electrodes are equidistantly spaced from the outer surface of the semispherical dome electrode 22.

Figure 13:
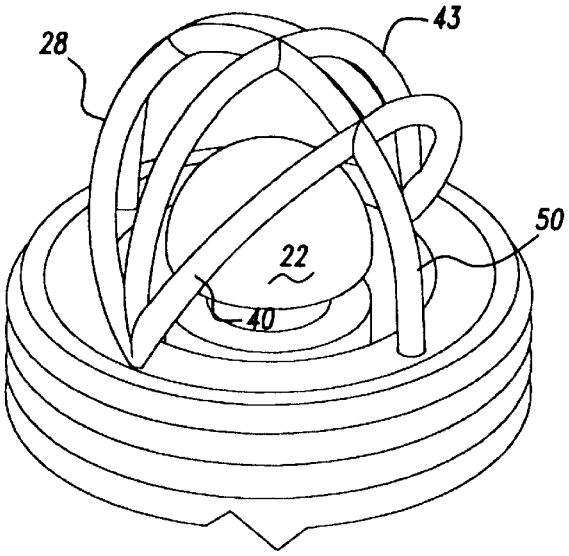
FIG. 13 is an elevational view illustrating a twelfth preferred embodiment of the present invention.

With reference now to FIG. 13, a still further embodiment of the electrode assembly is there shown and which, like the embodiment illustrated in FIG. 12, includes an aerodynamic semispherical dome electrode 22 as well as three semicircular electrodes 28, 40, and 50. Unlike the embodiment of FIG. 12, however, this embodiment contains a fourth semicircular electrode 43. This fourth semicircular electrode 43 intersects the semicircular electrodes 28 and 40 at their ends at various angles and intersects the semicircular electrode 50 generally perpendicularly. However, as before, the inner surfaces of these semicircular electrodes are equidistantly spaced from the aerodynamic semispherical dome electrode 22.

Figure 14:
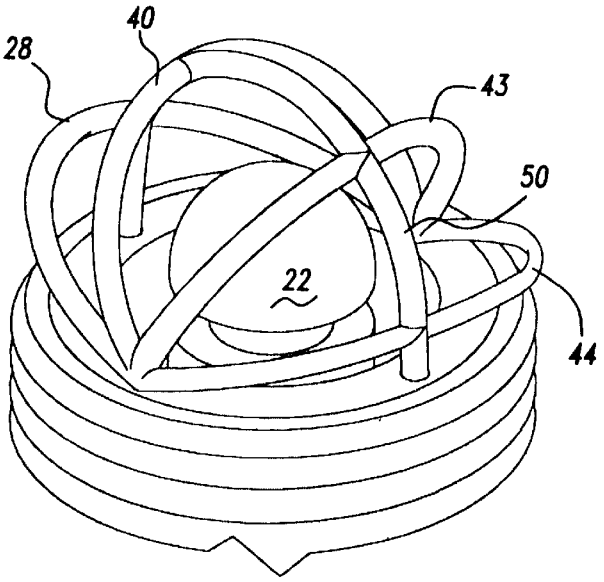
FIG. 14 is an elevational view of a portion of a thirteenth preferred embodiment of the present invention.

With reference now to FIG. 14, a still further embodiment of the electrode assembly is there shown and which, like the embodiment illustrated in FIG. 13, includes an aerodynamic semispherical dome electrode 22 as well as three semicircular electrodes 28, 40, 43, and 50. Unlike the embodiment of FIG. 13, however, this embodiment contains a fifth semicircular electrode 44. This fifth semicircular electrode 44 intersects the semicircular electrodes 28, 40, and 43 at their ends at various angles and intersects the semicircular electrode 50 generally perpendicularly. However, as before, the inner surfaces of these semicircular electrodes are equidistantly spaced from the aerodynamic semispherical dome electrode 22.

Figure 15:
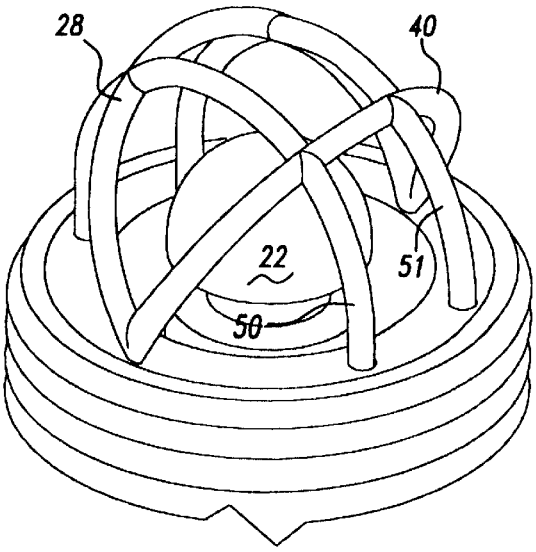
FIG. 15 is an elevational view illustrating a portion of a fourteenth preferred embodiment of the present invention.

With reference now to FIG. 15, a still further embodiment of the electrode assembly is there shown and which, like the embodiment illustrated in FIG. 12, includes an aerodynamic semispherical dome electrode 22 as well as three semicircular electrodes 28, 40, and 50. Unlike the embodiment of FIG. 12, however, this embodiment contains a fourth semicircular electrode 51. This fourth semicircular electrode 51 intersects the semicircular electrodes 28 and 40 generally perpendicularly, and it does not intersect the semicircular electrode 50. However, as before, the inner surfaces of these semicircular electrodes are equidistantly spaced from the aerodynamic semispherical dome electrode 22.

Figure 16:
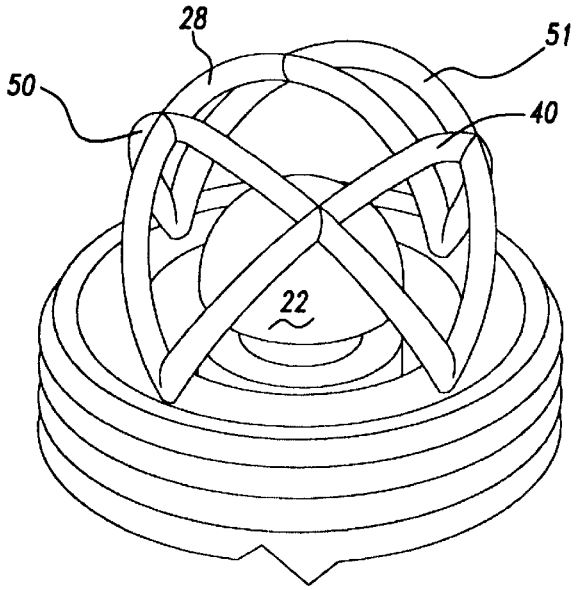
FIG. 16 is an elevational view illustrating a portion of a fifteenth preferred embodiment of the present invention.

With reference now to FIG. 16, a still further embodiment of the electrode assembly is there shown and which, like the embodiment illustrated in FIG. 14, includes an aerodynamic semispherical dome electrode 22 as well as four semicircular electrodes 28, 40, 50, and 51. Unlike the embodiment of FIG. 15, the third and fourth semicircular electrodes 50 and 51 intersect at their bases. However, as before, the inner surfaces of these semicircular electrodes are equidistantly spaced from the aerodynamic semispherical dome electrode 22.

Figure 17:
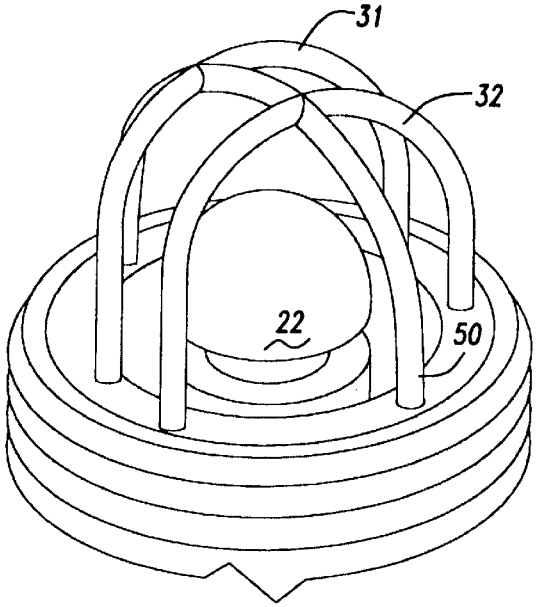
FIG. 17 is an elevational view illustrating a sixteenth preferred embodiment of the present invention.

With reference now to FIG. 17, a still further embodiment of the electrode assembly 16 is there shown and which, like the embodiment illustrated in FIG. 7, includes the aerodynamic semispherical dome electrode 22 as well as two semicircular electrodes 31 and 32 that are spaced apart. Unlike the embodiment of FIG. 7, however, this embodiment contains a third semicircular electrode 50 that intersects semicircular electrodes 31 and 32 generally perpendicularly at the apex. However, as before, the inner surfaces of electrodes 31, 32, and 50 are equidistantly spaced from the aerodynamic semispherical dome electrode 22.

Figure 18:
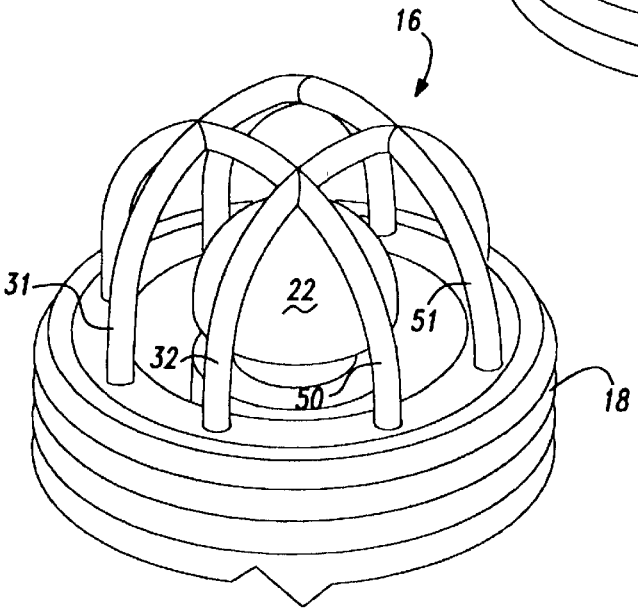
FIG. 18 is an elevational view of a portion of a seventeenth preferred embodiment of the present invention.

With reference now to FIG. 18, a still further embodiment of the electrode assembly 16 is there shown and which, like the embodiment illustrated in FIG. 17, includes the aerodynamic semispherical dome electrode 22 as well as two semicircular electrodes 31 and 32 that are spaced apart and a third semicircular electrode 50 that intersects semicircular electrodes 31 and 32 generally perpendicularly. Unlike the embodiment of FIG. 17, however, this embodiment contains a fourth semicircular electrode 51 that intersects semicircular electrodes 31 and 32 generally perpendicularly. Furthermore, semicircular electrodes 50 and 51 are spaced apart and parallel to each other. However, as before, the inner surfaces of the semicircular electrodes 31, 32, 50, and 51 are equidistantly spaced from the aerodynamic semispherical dome electrode 22.

Figure 19:
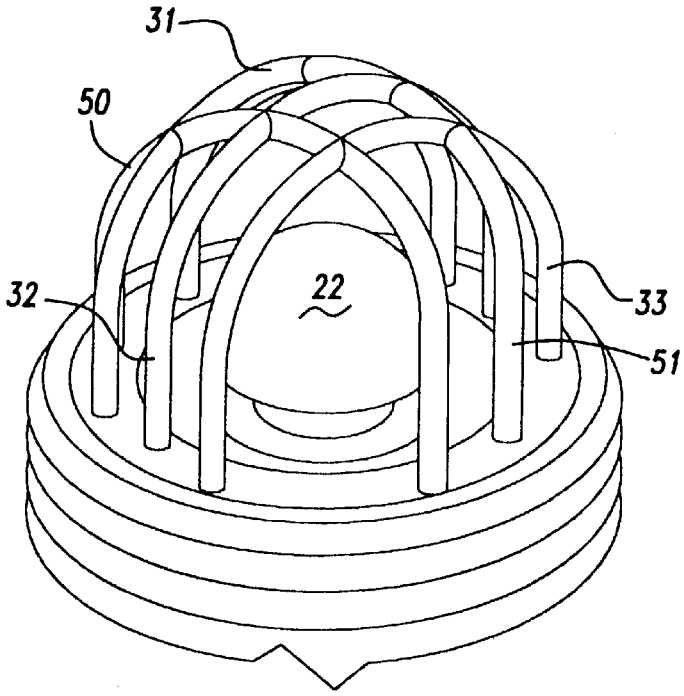
FIG. 19 is an elevational view of a portion of an eighteenth preferred embodiment of the present invention.

With reference now to FIG. 19, a still further embodiment of the electrode assembly 17 is there shown and which, like the embodiment illustrated in FIG. 18, includes the aerodynamic semispherical dome electrode 22 as well as two semicircular electrodes 31 and 32 that are spaced apart and two additional semicircular electrodes 50 and 51 that are spaced apart. The semicircular electrodes 31 and 32 intersect and are generally perpendicular to semicircular electrodes 50 and 51. Unlike the embodiment of FIG. 18, however, this embodiment contains a fifth semicircular electrode 33 that is spaced apart from semicircular electrodes 31 and 32. Furthermore, semicircular electrodes 50 and 51 intersect semicircular electrode 33 generally perpendicularly. However, as before, the inner surfaces of the semicircular electrodes 31, 32, 33, 50, and 51 are equidistantly spaced from the aerodynamic semispherical dome electrode 22. As stated before, all semicircular electrodes are electrically connected to the metal boss 18 and thus to the internal combustion engine.

Figure 20:
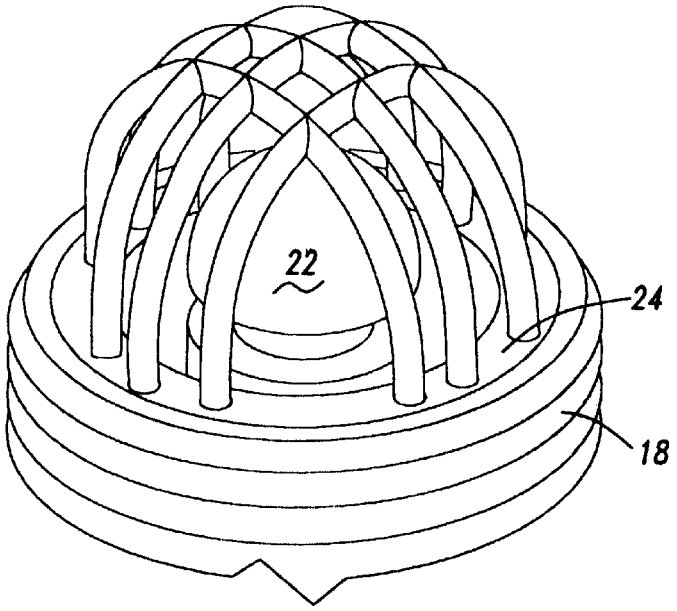
FIG. 20 is an elevational view of a portion of a nineteenth preferred embodiment of the present invention.

With reference now to FIG. 20, a still further embodiment of the electrode assembly 19 is there shown and which, like the embodiment illustrated in FIG. 19, includes the aerodynamic semispherical dome electrode 22 as well as three semicircular electrodes 31, 32 and 33 that are spaced apart and three additional semicircular electrodes 50, 51 and 52 that are spaced apart. The semicircular electrodes 31, 32 and 33 intersect and are generally perpendicular to semicircular electrodes 50, 51 and 52. However, as before, the inner surfaces of the semicircular electrodes 31, 32, 33, 50, 51 and 52 are equidistantly spaced from the aerodynamic semispherical dome electrode 22. As stated before, all semicircular electrodes are electrically connected to the metal boss 18 and thus to the internal combustion engine.

Figure 21:
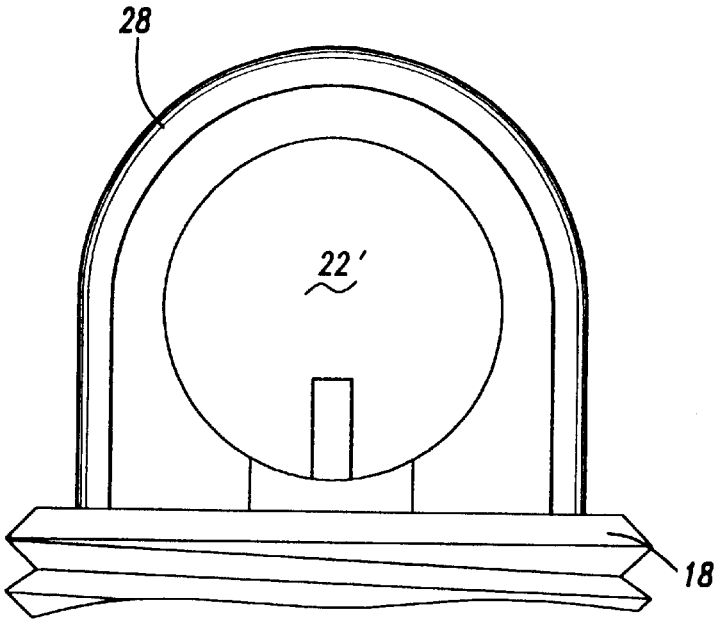
FIGS. 21 and 22 are side views illustrating alternative embodiments of the electrode.
Figure 22:
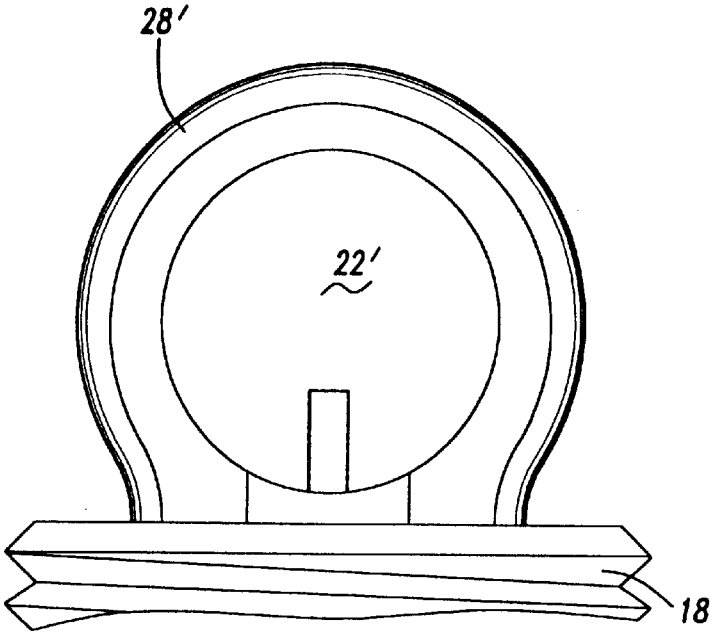

With reference now to FIGS. 21 and 22, further embodiments of the electrode assembly are there shown in which the cathode electrode 22' is spherical in shape rather than the semispherical cathode electrodes 22 of FIGS. 1–20. Although only one electrode 28 (FIG. 21) or 28' (FIG. 22) is shown, the spherical electrode 22' can be utilized in conjunction with any of the anode electrode configurations of FIGS. 1–20. Furthermore, the anode electrode 28 or 28' may be either U-shaped as shown in FIG. 21 or semicircular in shape as shown in FIG. 22 in order to maintain the distance between the electrodes 28' and 22' equidistance along substantially the entire length of the electrode 28'.

From the foregoing, it can be seen that the present invention provides a novel spark plug construction which completely overcomes the previously mentioned disadvantages of the previously known spark plug constructions. Having described my invention, however, many modifications thereto will become apparent to those skilled in the art to which it pertains without deviation from the spirit of the invention as defined by the scope of the appended claims.

We claim:

1. A spark plug for an internal combustion engine comprising:

a body having an electrical connector at one end, a dome electrode having a semispherical surface secured to a second end of said body, means for electrically connecting said connector to said dome electrode, and at least one semicircular electrode secured to said body such that said at least one semicircular electrode has an inner surface equidistantly spaced from said dome electrode along a portion of the length of said inner surface, said portion forming an arc surface of said semicircular electrode.

2. The invention as defined in claim 1 wherein said at least one semicircular electrode comprises two semicircular electrodes, said semicircular electrodes being attached at midpoints of said semicircular electrodes.

3. The invention as defined in claim 1 wherein said at least one semicircular electrode comprises two semicircular electrodes secured to said body such that said semicircular electrodes each have a circular inner surface spaced from said dome electrodes said semicircular electrodes each having two ends and a midpoint and being spaced from each other at the midpoints of said semicircular electrodes and attached at their ends.

4. The invention as defined in claim 1 wherein said at least one semicircular electrode comprises two semicircular electrodes secured to said body such that each of said semicircular electrodes has an inner circular surface equidistantly spaced from said semispherical electrode along at least a portion of said inner circular surface, said semicircular electrodes being spaced from each other along the entire length of said semicircular electrodes.

5. The invention as defined in claim 1 wherein said at least two semicircular electrodes comprise two semicircular electrodes, each having two ends secured to said body, wherein semicircular electrodes are attached to each other at a point intermediate said ends.

6. The invention as defined in claim 3 and comprising a third semicircular electrode attached at intermediate points to said first two mentioned semicircular electrodes.

7. The invention as defined in claim 3 and comprising a third semicircular electrodes attached at a midpoint to said first two mentioned semicircular electrodes.

8. The invention as defined in claim 4 and comprising a third semicircular electrode, said third electrode being attached to midpoints of said first two mentioned semicircular electrodes.

9. The invention as defined in claim 1 wherein said dome electrode has a semispherical outer surface.

10. The invention as defined in claim 1 wherein said dome electrode is spherical in shape.

* * * * *

UNITED STATES PATENT AND TRADEMARK OFFICE

CERTIFICATE OF CORRECTION

PATENT NO. : 5,936,332
DATED : August 10, 1999
INVENTOR(S) : Robert Krupa and Chester C. Lulavage It is certified that error appears in the above-identified patent and that said Letters Patent is hereby corrected as shown below:

Column 8,
Line 28, delete “electrodes” between “dome” and “said,” insert -- electrode --;
Line 43, insert -- said -- between “wherein” and “semicircular”;
Line 55, delete “claim 9”.

Signed and Sealed this

Twenty-fourth Day of December, 2002

JAMES E. ROGAN
*Director of the United States Patent and Trademark Office*